US011391233B2

(12) United States Patent
Bavois

(10) Patent No.: US 11,391,233 B2
(45) Date of Patent: Jul. 19, 2022

(54) METHOD FOR CONTROLLING A HIGH-PRESSURE FUEL INJECTOR

(71) Applicant: VITESCO TECHNOLOGIES GMBH, Hannover (DE)

(72) Inventor: Thierry Bavois, Toulouse (FR)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 17/424,205

(22) PCT Filed: Mar. 23, 2020

(86) PCT No.: PCT/EP2020/057932
§ 371 (c)(1),
(2) Date: Jul. 20, 2021

(87) PCT Pub. No.: WO2020/193456
PCT Pub. Date: Oct. 1, 2020

(65) Prior Publication Data

US 2022/0106922 A1 Apr. 7, 2022

(30) Foreign Application Priority Data

Mar. 26, 2019 (FR) ..... 1903118

(51) Int. Cl.
*F02D 41/20* (2006.01)

(52) U.S. Cl.
CPC ..... *F02D 41/20* (2013.01); *F02D 2041/201* (2013.01); *F02D 2041/2003* (2013.01);
(Continued)

(58) Field of Classification Search
CPC ..... F02D 41/20; F02D 2041/2003; F02D 2041/2006; F02D 2041/201; F02D 2041/2082; F02D 2400/16
(Continued)

(56) References Cited

U.S. PATENT DOCUMENTS 3,665,901 A 5/1972 Monpetit et al.
4,774,624 A 9/1988 Qualich
(Continued)

FOREIGN PATENT DOCUMENTS

DE 197 01 471 7/1998
DE 198 33 830 2/2000
DE 10 2012 218157 4/2013

OTHER PUBLICATIONS

International Search Report for PCT/EP2020/057932 dated Jun. 2, 2020, 3 pages.
(Continued)

*Primary Examiner* — Erick R Solis
(74) *Attorney, Agent, or Firm* — Nixon & Vanderhye

(57) ABSTRACT

Method for controlling a fuel injector with a solenoid actuating a needle opening the injector and a spring returning the needle to the closed position. A controller, powering the solenoid, provides a first potential connected to a first transistor's drain, the source of the first transistor connected to the first diode's anode, the cathode of the first diode connected to a second diode's cathode, to a first connector of the solenoid and to the source of a second transistor. The drain of a second transistor is connected to a second potential, the second diode's anode being connected to ground, the second potential being connected to ground via a capacitance and to the cathode of a third diode, the third diode's anode being connected to a second connector of the solenoid and to the drain of a third transistor, the source of the third transistor being connected to ground.

4 Claims, 4 Drawing Sheets

(52) U.S. Cl.
CPC ..... *F02D 2041/2006* (2013.01); *F02D 2041/2082* (2013.01); *F02D 2400/16* (2013.01)

(58) Field of Classification Search
USPC ..... 123/490; 701/103
See application file for complete search history.

(56) References Cited

U.S. PATENT DOCUMENTS

| | | | | |
|---|---|---|---|---|
| 6,250,286 | B1 | 6/2001 | Hoenig et al. | |
| 6,505,609 | B1 | 1/2003 | Biester et al. | |
| 8,978,625 | B2 * | 3/2015 | Okuda | F02D 41/20 123/490 |
| 9,476,330 | B2 * | 10/2016 | Kojima | F02D 41/20 |
| 10,774,772 | B2 * | 9/2020 | Yamaoka | F02D 41/402 |
| 10,837,392 | B2 * | 11/2020 | Inaba | F02D 41/365 |
| 11,105,290 | B2 * | 8/2021 | Tsukio | F02D 41/20 |
| 2005/0047053 | A1 * | 3/2005 | Meyer | F02D 41/20 361/139 |
| 2008/0289607 | A1 * | 11/2008 | Mayuzumi | F02D 41/20 123/490 |
| 2011/0273812 | A1 | 11/2011 | Beer et al. | |

OTHER PUBLICATIONS

Written Opinion of the ISA for PCT/EP2020/057932 dated Jun. 2, 2020, 10 pages.

* cited by examiner

METHOD FOR CONTROLLING A HIGH-PRESSURE FUEL INJECTOR

CROSS-REFERENCE APPLICATION TO RELATED APPLICATIONS

This application is the U.S. national phase of International Application No. PCT/EP2020/057932 filed Mar. 23, 2020 which designated the U.S. and claims priority to FR Patent Application No. 1903118 filed Mar. 26, 2019, the entire contents of each of which are hereby incorporated by reference.

BACKGROUND OF THE INVENTION

Field of the Invention

The technical field of the invention is that of controlling high-pressure fuel injectors, and more particularly that of generating the control voltages for such injectors.

Description of the Related Art

High-pressure fuel injectors comprise a needle actuated by a solenoid and a return spring.

In order to trigger fuel injection, the needle is raised so as to open the orifice of the injector and to put the fuel inlet, such as an injection common rail, in communication with the combustion chamber. To achieve this, a current is passed through the solenoid with sufficient strength to generate a magnetic force greater than the return force of the spring.

In order to stop the injection, the needle must be pushed back into the injector so as to close the orifice of the injector. To achieve this, the flow of current through the solenoid is interrupted. The magnetic force being interrupted, the return spring returns the needle to its rest position, closing the orifice of the injector.

Throughout the rest of the description, no distinction will be made between the solenoid of the injector and the injector in the context of power supply and control.

More precisely, a high-pressure fuel injector requires an inrush current or peak current, denoted by PEAK throughout the rest of the description, to open, allowing the needle to be raised to the open position. Once the open position has been reached, it is kept open by lower-strength currents which have a first strength and a second strength, and which are denoted by HOLD1 and HOLD2, respectively, throughout the rest of the description. FIG. 1 illustrates these different currents in a fuel injection phase.

The generation of the PEAK current involves current regulation using a potential Vboost.

The generation of the HOLD1 and HOLD2 currents involves current regulation. Given the strength and regulation thereof, the HOLD1 and HOLD2 currents can be obtained using the battery voltage Vbat.

Once the PEAK current has been generated, the value of the potential Vboost is reduced, such that it is necessary to raise it back up before generating a PEAK current again.

To achieve this, the control means are generally controlled so as to generate a current from the battery to the potential Vboost. Such a mechanism assumes that the battery voltage Vbat is lower than the potential Vboost.

However, in some vehicles, the battery has a voltage of 48 V which may vary within a wide range of values. The battery voltage Vbat may then be higher than the potential Vboost.

It is then necessary to use a voltage step-down circuit, also called a buck circuit, in order to regenerate the potential Vboost.

In the case of supplying a fuel injector with power from a 48 V automotive battery, the voltage step-down circuit required is particularly substantial and expensive.

There is a need for control for a high-pressure fuel injector that does not require a voltage step-down circuit separate from the control means in order to reduce the bulk and cost of control for a fuel injector.

No control means for a high-pressure fuel injector exist which do not require a voltage step-down circuit separate from the control means.

The technical problem identified above remains.

SUMMARY OF THE INVENTION

The subject of the invention is a method for controlling a high-pressure fuel injector for an internal combustion engine of a motor vehicle, the injector being provided with a solenoid for actuating a needle which opens the injector and with a spring for returning said needle to the closed position, the solenoid of the fuel injector being supplied with current by a control means comprising a first potential connected to the drain of a first transistor, the source of the first transistor being connected to the anode of a first diode, the cathode of the first diode being connected to the cathode of a second diode, to a first connector of the solenoid of the injector, and to the source of a second power transistor, the drain of a second transistor being connected to a second potential, the anode of the second diode being connected to ground, the second potential being connected to ground via a capacitance, the second potential also being connected to the cathode of a third diode, the anode of the third diode being connected to a second connector of the solenoid of the injector and to the drain of a third transistor, the source of the third transistor being connected to ground via a resistor.

The control means further comprises an additional diode connected by its anode to the source of the second transistor and by its cathode to the first connector of the injector, the control method comprise the following steps:

- it is determined whether the second potential is lower than the potential threshold allowing a current for opening the needle of the injector to be generated,
- if this is the case, it is determined whether the first potential is higher than the second potential,
- if this is the case, it is determined whether an injection is not required,
- if this is the case, the transistors of the control means are controlled first so as to be a first state in which the first transistor is controlled so as to be on and the second transistor and the third transistor are controlled so as to be off and then, after detecting a solenoid charging current greater than a reference current through the first transistor, the transistors are controlled so as to be in a second state in which the first transistor, the second transistor and the third transistor are controlled so as to be off so as to obtain a charge transfer effect between the input first potential and the second potential,
- a predetermined time is waited to allow the solenoid to discharge,
- it is determined whether the second potential is lower than the potential threshold allowing a current for opening the needle of the injector to be generated,
- if this is the case, the method returns to charging the solenoid of the injector.

When it has been determined that an injection is required, it may be determined whether regulation of the current flowing through the solenoid of the injector is under way.

if this is the case, when a decrease in the regulated current is required, the first transistor is controlled so as to be off so as to discharge the solenoid of the injector by making the current flow through the second diode and the third diode, while controlling the second transistor and third transistor so as to be off.

The first potential may be equal to the potential of the battery that supplies the motor vehicle with power.

BRIEF DESCRIPTION OF THE DRAWINGS

Further aims, features and advantages of the invention will become apparent from reading the following description, given solely by way of non-limiting example, and with reference to the appended drawings, in which.

DESCRIPTION OF THE PREFERRED EMBODIMENTS

Figure 2:
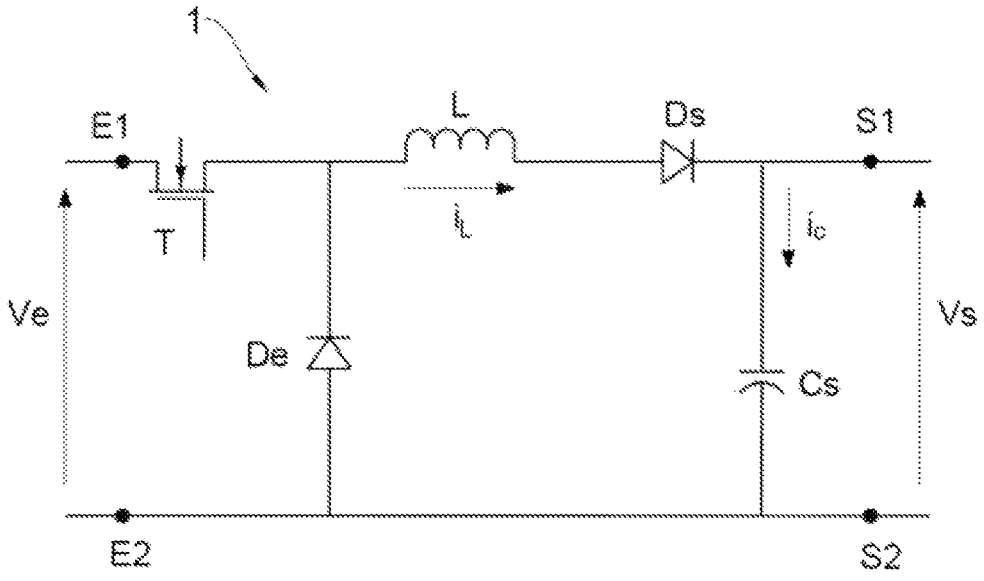
FIG. 2 illustrates the main elements of a voltage step-down circuit.

FIG. 2 illustrates a voltage step-down circuit used to regenerate the potential Vboost.

The voltage step-down circuit 1 comprises a first input E1, a second input E2, a first output S1 and a second output S2.

A transistor T is connected by its drain to the first input E1 and by its source to one end of the inductance L and to the cathode of an input diode De.

The other end of the inductance L is connected to the anode of an output diode Ds. The cathode of the output diode Ds is connected to the first output S1 and to one end of a capacitance Cs, the other end of the capacitance Cs being connected to the second input E2, to the second output S2 and to the anode of the input diode De.

An input voltage Ve is applied between the two inputs E1, E2, while the transistor T is controlled so as to close if the output voltage Vs is lower than its nominal voltage. The current in the inductance L increases, up to its charge value.

When the transistor T is controlled so as to open, the inductance L is discharged through the input diode De and the two outputs S1, S2. The output voltage Vs lower than the previously applied input voltage Ve making it possible to supply the continuous current required by a load at output.

It should be noted that the capacitor Cs is charged during the charging and discharging of the inductance L. The capacitor Cs is then discharged when an additional current is drawn at output. The capacitor Cs makes it possible to smooth the output voltage.

The transistor T is switched fast enough to be able to quickly charge the capacitance at output in order to supply current to a load.

Figure 3:
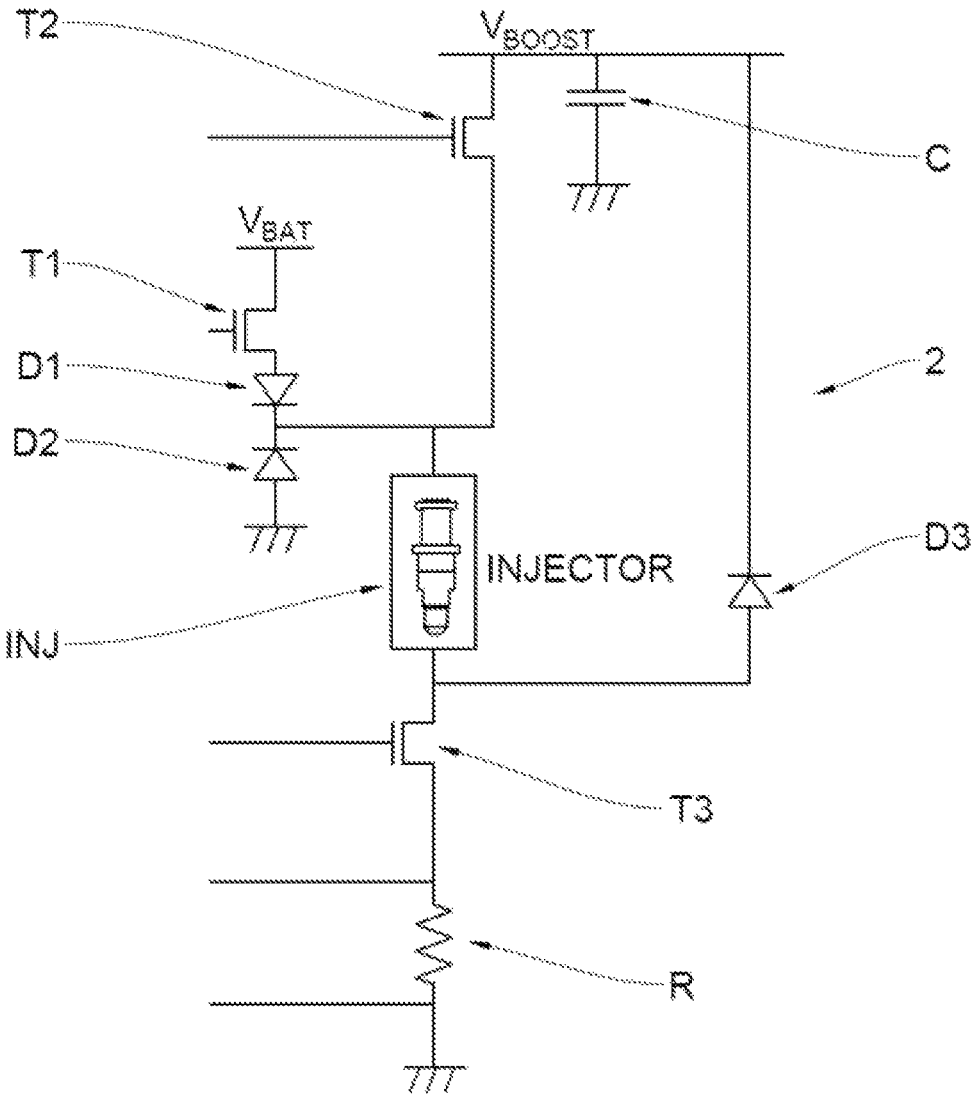
FIG. 3 illustrates the main elements of a means for controlling an injector.

In FIG. 3, the structure of a means 2 for controlling a high-pressure fuel injector can be seen.

The control means comprises a first potential Vbat, generally connected to the battery. The first potential Vbat is connected to the drain of a first power transistor T1. The source of the first power transistor T1 is connected to the anode of a first diode D1. The cathode of the first diode D1 is connected to the cathode of a second diode D2, to a first connector of the injector INJ, and to the source of a second power transistor T2. The drain of the second power transistor T2 is connected to a second potential Vboost. The second potential Vboost is generally connected to a voltage step-up circuit 1 as illustrated in FIG. 2.

The anode of the second diode D2 is connected to ground.

The second potential Vboost is connected to ground via a capacitance C.

The second potential Vboost is also connected to the cathode of a third diode D3, the anode of the third diode D3 being connected to a second connector of the injector INJ and to the drain of a third power transistor T3. The source of the third power transistor T3 is connected to ground via a resistor R.

The control means also comprises a means for measuring the first potential Vbat, a means for measuring the second potential Vboost and a means for measuring the current flowing through the resistor R.

Controlling the three transistors T1, T2, T3 makes it possible to generate and regulate the various currents supplying the injector INJ with power.

In particular, if the first transistor T1 is controlled so as to be off while the second transistor T2 and the third transistor T3 are controlled so as to be on, a current flows from the second potential Vboost through the injector INJ and the resistor R to ground.

The current obtained then corresponds to the PEAK current. The generation of such a current removes or greatly decreases a large portion of the second potential Vboost. It is then necessary to raise the potential of the second potential Vboost back up to a predetermined level allowing the PEAK current to be generated.

If the first transistor T1 and the second transistor T2 are controlled so as to be off while the third transistor T3 is controlled so as to be on, a current flows through the second diode D2, the injector INJ and the resistor R to ground.

The strength of the current flowing through the injector INJ then decreases to the HOLD1 current which is then regulated.

A similar mechanism is employed to regulate the strength when going from a HOLD1 current to a HOLD2 current, which is then regulated.

If the first transistor T1 and the third transistor T3 are controlled so as to be on while the second transistor T2 is controlled so as to be off, a current flows from the first potential Vbat through the first diode D1, the injector INJ and the resistor R to ground.

The strength of the current flowing in the injector INJ then increases to the HOLD1 current. A new phase for decreasing the current is then initiated as described above.

A similar mechanism is employed to increase strength when regulating the strength of the current so as to be around a specified value, for example around HOLD2.

If the first transistor T1, the second transistor T2 and the third transistor T3 are controlled so as to be off, a current flows through the second diode D2, the injector INJ, the third diode D3, the second potential Vboost, and the capacitor C to ground.

The strength of the current flowing through the injector INJ then decreases rapidly, making it possible to reach zero strength and to cut the opening of the injector and go from the HOLD2 current to zero strength.

The inventor noticed that the structure of the control means for the injector comprised elements in common with the structure of a voltage step-down circuit as illustrated in FIG. 2.

It may thus be seen that the transistor T of FIG. 2 corresponds to the first transistor T1 of FIG. 3, the input diode De of FIG. 2 to the second diode D2 of FIG. 3, the output diode Ds of FIG. 2 to the third diode D3 of FIG. 3, the capacitance Cs of FIG. 2 to the capacitor C of FIG. 3 and the inductance L to the solenoid of the injector INJ through which the current flows.

The control means may be used to raise the second potential Vboost up to the potential required to obtain the PEAK current from a battery voltage higher than the potential required to obtain the PEAK current.

To achieve this, when the inductance of the injector INJ is discharged to a zero value corresponding to cutting the injector, the first transistor T1 is controlled so as to be on so as to charge the injector INJ, while controlling the second transistor T2 and third transistor T3 so as to be off.

A current is thus generated that makes it possible to raise the potential of the second potential Vboost.

The discharging of the inductance may be achieved by way of the expected operation of the control means, in particular by controlling the first transistor T1 and the second transistor T2 so as to be off and the third transistor T3 so as to be off.

A decrease in the charge of the injector is thus obtained so as to obtain a topology similar to a voltage step-down circuit.

However, when the potential Vbat is higher than the potential Vboost, a reverse current may flow through the second transistor T2 when the first transistor T1 is controlled so as to be on since this has the effect of increasing the potential Vboost above the operating voltage of the second transistor T2. In order to avoid a detrimental situation such as this, an additional diode Dadd is added so as to prevent a current from flowing from the first potential Vbat to the second potential Vboost through the second transistor T2.

Figure 4:
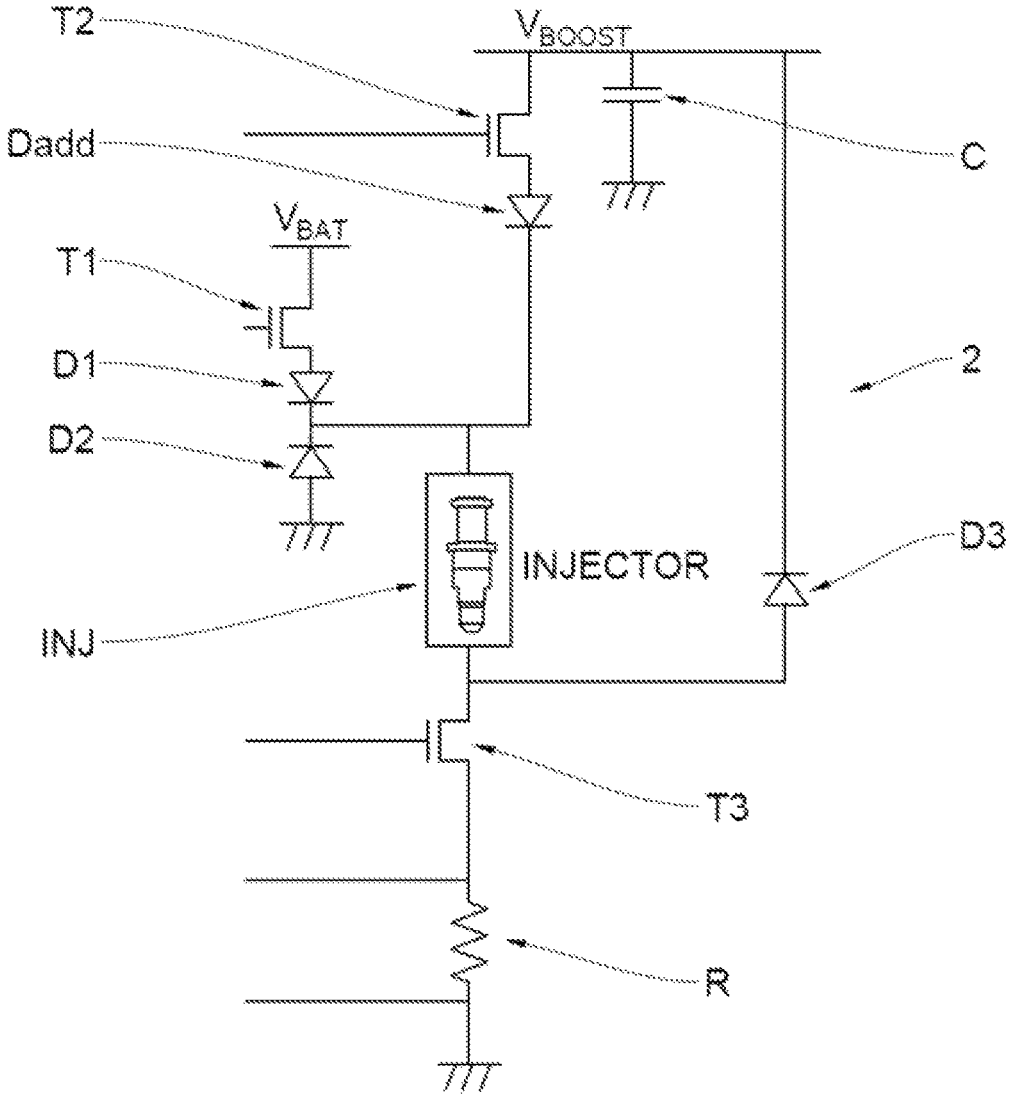
FIG. 4 illustrates the main elements of a means for controlling an injector which is modified when the second potential is higher than the first potential well.

The additional diode Dadd has to be arranged so that its cathode is connected to the cathode of the first diode D1, to the cathode of the second diode D2, and to the injector INJ, while its anode is connected to the source of the second transistor T2. FIG. 4 illustrates a modified control means comprising an additional Dadd diode.

Figure 1:
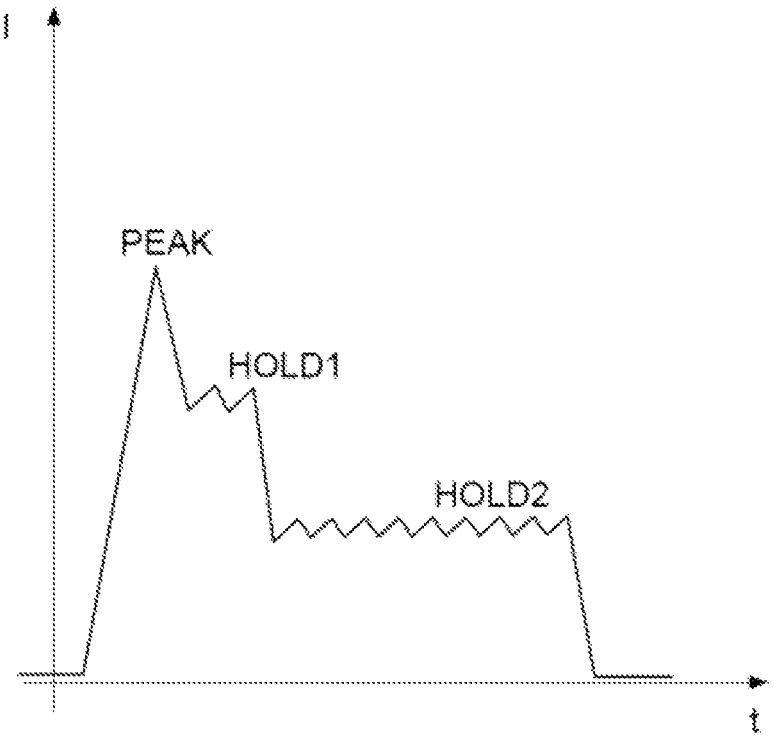
FIG. 1 illustrates the main changes in the current flowing through the solenoid of the injector during an injection.

The control means for the injector exchanges instructions for switching the transistors T1, T2, T3 with an electronic control unit and transmits values of the measured currents and potentials. The electronic control unit is thus able to determine the current injector control phase, according to the instructions received from engine control and in conjunction with the change in the current flowing through the injector illustrated in FIG. 1.

The method for controlling the injector thus applies to the means for controlling the injector and to its electronic control unit.

Figure 5:
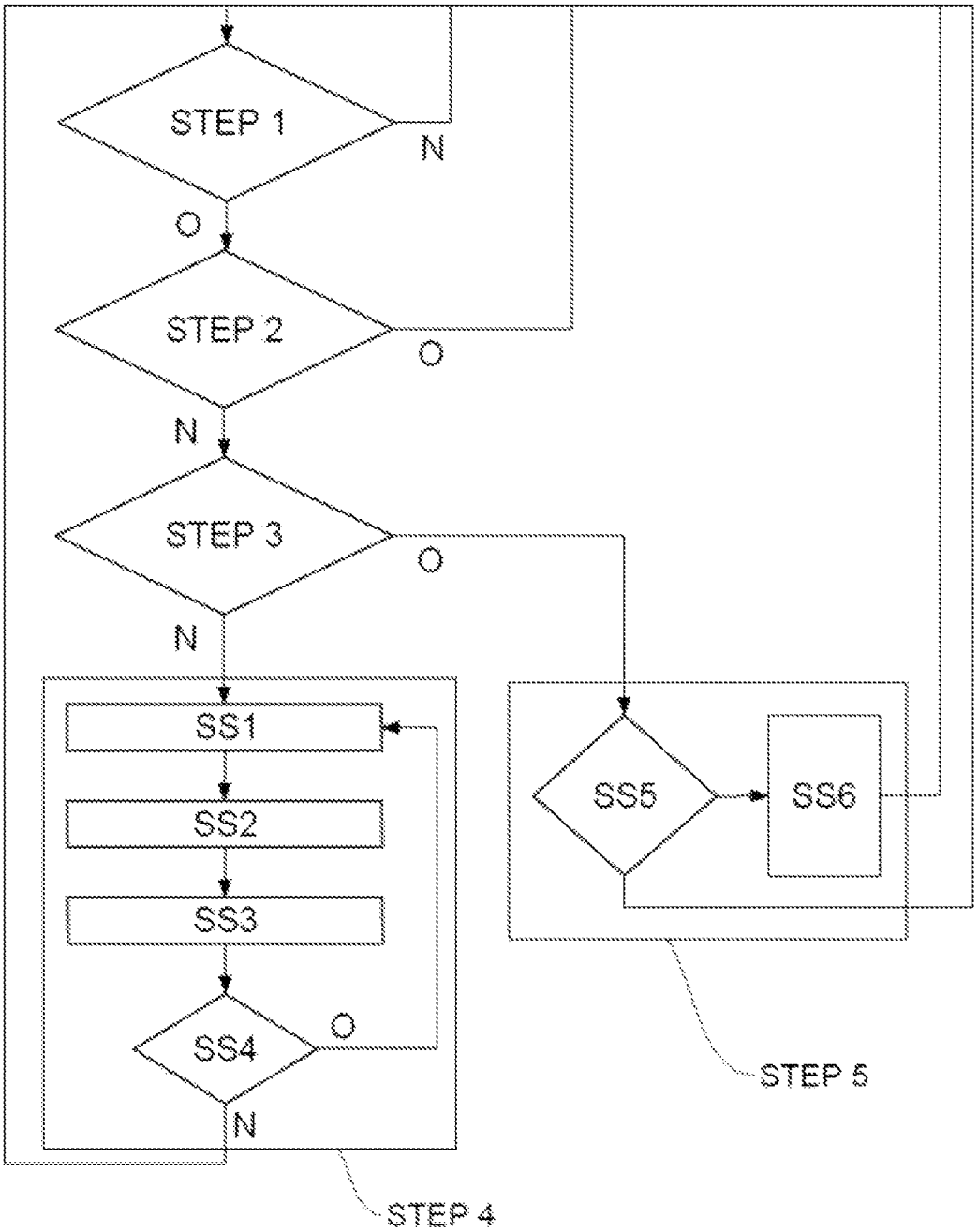
FIG. 5 illustrates the main steps of a method for controlling an injector.

In FIG. 5, it can be seen that the method for controlling the injector comprises a first step STEP1 during which the value of the second potential is determined, and then it is determined whether the second potential is lower than a predetermined potential threshold, allowing a PEAK current for opening the needle of the injector to be generated.

If this is not the case, the second potential is already at the level required to generate the PEAK current. The method then returns to the first step STEP1.

If this is the case, the method continues on to a second step STEP2 during which the value of the second potential is determined, and then it is determined whether the first potential Vbat is higher than the second potential Vboost.

If this is not the case, the method returns to the first step STEP1.

If this is the case, the method continues on to a third step STEP3 during which it is determined whether an injection is not required.

If this is the case, the method continues on to a third step STEP4 during which the transistors are controlled first so as to be in a first state of the control means in which the first transistor T1 is controlled so as to be on and the second transistor T2 and the third transistor T3 are controlled so as to be off in a first sub-step SS1 and then, after detecting an inductance charging current greater than a reference current through the first transistor T1, the transistors are controlled so as to be in a second state in which the first transistor T1, the second transistor T2 and the third transistor T3 are controlled so as to be off, in a second sub-step SS2. The method then returns to the first step STEP1.

In the first state, the inductance of the injector is charged with a reference current smaller than the activation current for the injector supplied by the first potential Vbat in a manner similar to the charging of a voltage step-down circuit.

In the second state, the inductance of the injector is discharged into the second potential Vboost.

During a third sub-step SS3, a predetermined time is waited to allow the solenoid to discharge. It should be noted that the waiting time is equal to a fixed value allowing a frequency equivalent to the frequency of a boost circuit to be defined.

During a fourth sub-step SS4, it is determined whether the second potential is lower than the potential threshold allowing a current for opening the needle of the injector to be generated, if this is the case, the method returns to charging the solenoid of the injector in step SS1.

If this is not the case, the method returns to step STEP1.

If, in the third step STEP3, it has been determined that an injection is required, the method continues on to a fourth step STEP5, during which, in a third sub-step SS5, it is determined whether regulation of the current flowing through the injector is under way.

If this is not the case, the method returns to the first step STEP1.

If this is the case, during a fourth sub-step SS6, it is determined when a decrease in the regulated current is required. When this is the case, the first transistor T1 is controlled so as to be off so as to discharge the injector INJ into the second potential, while controlling the second transistor T2 and third transistor T3 so as to be off. The method then returns to the first step STEP1.

Once the current flowing through the injector is being regulated, it is then possible to recover a fraction of the energy used to discharge the injector so as to raise the second potential back up to the predetermined value, while the battery voltage is higher than the second potential.

The control method makes it possible to use the components of the control means to form a voltage step-down circuit in order to increase the second potential from a battery voltage higher than the voltage of the second potential. If an injection is under way, there is reuse of the energy that has to be supplied to the injector in order to regulate the current thereof so as to be at a setpoint value, in particular HOLD1 and HOLD2. If no injection is required, the control means is controlled so as to be able to charge the solenoid of the injector to the second potential in the form of a voltage step-down circuit and then discharge it conventionally.

Thus, the structure of the control means may be used in all injector operating phases.

The invention claimed is:

1. A method for controlling a high-pressure fuel injector for an internal combustion engine of a motor vehicle, the injector being provided with a solenoid for actuating a needle which opens the injector and with a spring for returning said needle to the closed position, the solenoid of the fuel injector being supplied with current by a control means comprising a first potential connected to the drain of a first transistor, the source of the first transistor being connected to the anode of a first diode, the cathode of the first diode being connected to the cathode of a second diode, to a first connector of the solenoid of the injector, and to the source of a second power transistor, the drain of a second transistor being connected to a second potential, the anode of the second diode being connected to ground, the second potential being connected to ground via a capacitance (C), the second potential also being connected to the cathode of a third diode, the anode of the third diode being connected to a second connector of the solenoid of the injector and to the drain of a third transistor, the source of the third transistor being connected to ground via a resistor, wherein the control means further comprises an additional diode connected by the additional diode's anode to the source of the second transistor, the additional diode's cathode being connected to the first connector of the injector, the control method comprising the following steps:

determining whether the second potential is lower than the potential threshold allowing a current for opening the needle of the injector to be generated, if the second potential is lower than the potential threshold, determining whether the first potential is higher than the second potential, if the first potential is higher than the second potential, determining whether an injection is not required, if the injection is not required, controlling the transistors of the control means first so as to be a first state in which the first transistor is controlled so as to be on and the second transistor and the third transistor are controlled so as to be off and then, after detecting a solenoid charging current greater than a reference current through the first transistor, the transistors are controlled so as to be in a second state in which the first transistor, the second transistor and the third transistor are controlled so as to be off so as to obtain a charge transfer effect between the input first potential and the second potential, waiting a predetermined time to allow the solenoid to discharge, determining whether the second potential is lower than the potential threshold allowing a current for opening the needle of the injector to be generated, if the second potential is lower than the potential threshold, returning to charging the solenoid of the injector.

2. The control method as claimed in claim 1, wherein, when determining that an injection is required, further determining whether regulation of the current flowing through the solenoid of the injector is under way, if regulation of the current flowing through the solenoid of the injector is under way, when a decrease in the regulated current is required, controlling the first transistor so as to be off so as to discharge the solenoid of the injector by making the current flow through the second diode and the third diode, while controlling the second transistor and third transistor so as to be off.

3. The control method as claimed in claim 1, wherein the first potential is equal to the potential of the battery that supplies the motor vehicle with power.

4. The control method as claimed in claim 2, wherein the first potential is equal to the potential of the battery that supplies the motor vehicle with power.

* * * * *